US006554908B1

(12) United States Patent
Negri et al.

(10) Patent No.: US 6,554,908 B1
(45) Date of Patent: Apr. 29, 2003

(54) PROCESS FOR PICKLING STAINLESS STEEL IN THE ABSENCE OF NITRIC ACID AND IN THE PRESENCE OF CHLORIDE IONS

(75) Inventors: Dario Negri, Bagnolo Cremasco (IT); Paolo Bruno Giordani, Crema (IT)

(73) Assignees: Henkel Kommanditgesellschaft auf Aktien, Dusseldorf (DE); Acciai Speciali Terni S.p.A., Terni (IT)

( * ) Notice: Subject to any disclaimer, the term of this patent is extended or adjusted under 35 U.S.C. 154(b) by 0 days.

(21) Appl. No.: 09/560,982

(22) Filed: Apr. 28, 2000

(30) Foreign Application Priority Data

May 3, 1999 (IT) ..... MI99A0943

(51) Int. Cl.[7] ..... C23G 1/02

(52) U.S. Cl. ..... 134/3; 134/2; 134/4; 134/19; 134/26; 134/28; 134/34; 134/41; 510/101; 510/245; 29/81.01; 29/367; 29/375; 29/379; 29/401

(58) Field of Search ..... 134/3, 2, 4, 6, 134/19, 26, 28, 34, 41; 148/95, 194, 240; 205/746, 749, 760; 510/101, 245, 367, 375, 379, 401; 29/81.01

(56) References Cited

U.S. PATENT DOCUMENTS

| | | | | |
|---|---|---|---|---|
| 3,907,716 A | * | 9/1975 | Haacke | 423/213.2 |
| 5,843,240 A | * | 12/1998 | Pedrazzini et al. | 134/19 |
| 6,068,001 A | * | 5/2000 | Pedrazzini et al. | 134/19 |
| 6,210,558 B1 | * | 4/2001 | Demertzis et al. | 205/746 |

FOREIGN PATENT DOCUMENTS

| | | | |
|---|---|---|---|
| CN | 1108703 | | 9/1995 |
| EP | 0188975 | | 7/1986 |
| EP | 0236354 | | 9/1987 |
| EP | 0582121 | | 2/1994 |
| EP | 0 582 121 A1 | | 2/1994 |
| EP | 0 769 574 A1 | | 4/1997 |
| GB | 2000196 | | 1/1979 |
| JP | 55018552 | * | 2/1980 |
| JP | 03023001 | * | 6/1989 |
| JP | 08243603 | * | 3/1995 |
| WO | WO 97/43463 | * | 11/1997 |
| WO | 98/2611 | | 6/1998 |

* cited by examiner

*Primary Examiner*—Randy Gulakowski
*Assistant Examiner*—M. Kornakov
(74) *Attorney, Agent, or Firm*—Hedman & Costigan, P.C.

(57) ABSTRACT

Process for pickling stainless steel carried out at a temperature of between 20° and 70° C., with the use of a pickling solution containing the following basic ingredients:

$H_2SO_4$ (free acid): 50 to 200 g/l

HF (free acid): 0 to 60 g/l $F^-$ anion (total): 5 to 150 g/l $SO_4^{2-}$ anion (total): 50 to 350 g/l Total free acidity ($H_2SO_4$+HF): between 1 and 7 g. equiv./l where by "free acid" is meant the acid that does not constitute the anion bound in the form of salts or complexes with the metal cations present in the solution; and, in addition:

$Fe^{3+}$ in a quantity of at least 15 g/l chloride anion in a quantity of between 0.1 and 10 g/l, into which solution is fed, during the pickling process, an oxidant that is able to oxidize $Fe^{2+}$ to $Fe^{3+}$ in order to maintain the redox potential of the solution at a value of between +230 and +800 mV.

11 Claims, No Drawings

PROCESS FOR PICKLING STAINLESS STEEL IN THE ABSENCE OF NITRIC ACID AND IN THE PRESENCE OF CHLORIDE IONS

TECHNICAL PROBLEM

In the course of processes of manufacture of steel products that undergo hot-rolling operations or of intermediate products that undergo thermal treatment, such as annealing, it has long been known that the material becomes coated with a more or less thick layer of products of oxidation. It is therefore necessary, considering the need to obtain a degree of surface finish of the finished product that is smooth and shiny, to removing entirely such oxide layers. This is performed through the well-known processes of pickling, for which mixtures of inorganic mineral acids, such as hydrochloric, sulphuric, nitric, and hydrofluoric acids, either alone or in various ratios between them, are generally used.

In the field of stainless steels, on the basis of the knowledge of the industrial processes today in use, the most commonly employed pickling operation involves the use of a mixture of nitric acid and hydrofluoric acid, the reciprocal concentrations of which in the mixture vary according to the type of plant, the type of steel to be pickled, its surface characteristics, and the geometry of the product to be treated. The process is certainly economic and enables excellent results to be obtained; it presents, however, the very serious drawback of creating problems of an ecological nature that are very important and difficult to solve on account of the use of nitric acid. In fact, on the one hand, vapours of nitrogen oxides of the general formula $NO_x$ are emitted into the atmosphere, these vapours being extremely polluting and aggressive in regard to the metallic and non-metallic materials with which they come into contact, and, on the other hand, in the washing water and in the exhausted baths high nitrate contents are reached, which consequently must then be disposed of. The problems of purification both of the $NO_x$ present in the air and of the nitrates present in the baths entail major problems in terms of plants and systems, high management costs, and the uncertainty of achieving the results required by current standards and regulations in this connection. In the final analysis, then, the expenditure in terms of investments is difficult to sustain in the majority of industrial plants.

A pickling system that does not require the use of nitric acid is therefore called for by industry, and various proposals, above all in the last ten years, have been made in this connection throughout the world.

Processes Alternative to the Use of Nitric Acid

STATE OF THE ART

From a critical examination of the patents for cycles proposed as an alternative to the traditional processes for pickling stainless steel based upon $HNO_3$+HF, which no longer contain nitric acid, and from a critical examination of the main technical literature on the subject, it has emerged that:

The British patent No. 2 000 196 of TOKAI Denka Kogyo envisages the use of a pickling bath consisting of ferric sulphate and hydrofluoric acid: to maintain an adequate concentration of ferric ions during the process, $H_2SO_4$ and hydrogen peroxide in a molar ratio of 1:1 are continuously fed in. The patent claims the method for controlling the process by continuously measuring the redox potential of the system, which is to be maintained at values ≧300 mV by regulating introduction of $H_2SO_4$+$H_2O_2$.

The two European patents, which moreover are very similar to one another, EP 188975 and EP 236354 (=WO 87/01739), bearing as dates of priority Jan. 22, 1985 and Sep. 19, 1985, respectively, envisage the use of a pickling solution consisting of hydrofluoric acid (5–50 g/l) and trivalent iron ions introduced in the form of fluorinated complexes, into which air or oxygen is blown continuously. The treatment time is from 30 seconds to 5 minutes, and the temperature ranges from 10° C. to 70° C. A continuous monitoring of the redox potential is moreover recommended; this potential must be maintained, for the first patent, at between −200 and +800 mV, and, for the second patent, at between +100 and +300 mV, and a possible addition of an oxidant, such as potassium permanganate or hydrogen peroxide, is recommended if it is necessary to increase the potential value. All the tests carried out regard pickling of sheet steel alone.

A substantial step forward has been made with the pickling process described in the European patent 582 121 of the present applicant, which employs a bath of $H_2SO_4$+HF containing $Fe^{3+}$ and $Fe^{2+}$ ions and operating at a controlled redox potential where the re-oxidation of the $Fe^{2+}$ ions to ferric ions is obtained by periodic additions of $H_2O_2$ to the pickling solution.

PROCESS ACCORDING TO THE INVENTION

The process that is the subject of the present patent application constitutes a technically valid, innovative, and from certain points of view, economically advantageous, evolution of the known processes mentioned above; in particular, it represents an important improvement of the previous patent EP 582 121 of the same applicant.

The process according to the present invention has proved particularly suitable for the pickling of stainless steels of the austenitic, ferritic and martensitic series, duplex steels, superaustenitic and superferritic steels, and Ni-based or Ni/Cr-based superalloys.

The process is based on the use of a pickling bath containing iron ions, HF, $H_2SO_4$, chloride anions, and conventional additives of the wetting, polishing and inhibiting-agent types, in which an oxidizing agent is continuously or periodically introduced, which is able to convert $Fe^{2+}$ ions that form in the pickling process into $Fe^{3+}$ ions, maintaining the redox potential of the pickling solution at the pre-established value.

The oxidizing agent can be introduced into the bath directly just as it is or in the form of an aqueous solution. The oxidation of $Fe^{2+}$ to $Fe^{3+}$ can be performed outside the pickling bath as a separate phase of operation, in particular with the method of electrolytic oxidation, such as the one described by WO.97/43.463; or else, it is possible to use air as oxidizing agent in the presence of a copper salt dissolved in the pickling solution as catalyst.

The basic characteristic of the process is the presence in the pickling bath of chloride anions in a ratio of 0.1 to 10 g/l, preferably 1 to 5 g/l.

The presence of chloride ions at the aforesaid concentration in HF, $H_2SO_4$ and $Fe^{3+}$ ion-based pickling solutions increases macroscopically the rate of pickling of stainless steels. This property is all the more evident and advantageous from the industrial standpoint, the greater the difficulty in removing the oxidized layer from the surface of the material.

The properties of the oxide layer, and hence its ease of removal from a stainless-steel substrate, depend upon numerous variables, the most important of which being the composition of the alloy, the conditions of the forms of heat treatment to which the material is subjected, and the thickness and compactness of the oxide layer.

In industrial practice, the situations presenting greater difficulty are found in the treatment of duplex steels, austenitic steels with high chrome content, and chrome-nickel alloys.

In these cases, it may be found that the only way to achieve an effective pickling result in acceptable times is to carry out, prior to the pickling stage, a stage of mechanical pre-treatment (sand-blasting) or chemical pre-treatment (hot-oxidizing aqueous solutions, such as $NaOH+KMnO_4$) or chemico-physical pre-treatment (oxidizing or reducing molten salts) so as to modify the compactness or nature of the oxide.

In addition, sometimes a preliminary chemical treatment is carried out with an aqueous solution containing $H_2SO_4$, HCl, HF and their mixtures.

It has been found, according to the present invention, that the addition of chloride ions to a pickling solution containing sulphuric acid, hydrofluoric acid and ferric ions enables, in addition to the acceleration of the pickling rate on each degree of material, also direct pickling in industrially acceptable times of materials that must normally undergo a pre-treatment, like the ones already described.

The reason probably lies in the action of depassivation that the chloride ion is able to exert on the dechromized layer, thus considerably accelerating the phase of detachment of the oxide scale.

For this reason, the concentration of chloride ions represents a critical parameter of the process and must be carefully controlled and monitored.

The concentration of the chloride ions in the pickling bath can be measured with high precision by titration with silver nitrate in the presence an ion-selective electrode which detects the variation in the concentration of $Cl^-$ ions in the solution.

Values of chloride-ion concentration that are too high (>10 g/l) do determine an increase in the pickling rate, but at the same time considerably accelerate also the speed of attack on the base alloy.

Considering that in the pickling process, above all in wire-rod and tube pickling, the pickling times may in any case be very long (30–180 min), an excessive speed of reaction on the base metal may cause an excessively uneven and corroded, and hence industrially unacceptable, surface.

It has been verified that the increase in pickling rate found according to the present invention is not caused by an increase in the acidity of the system. In fact, the effect of the addition of chloride ions is found to be equivalent both when the addition is in the form of salt (e.g., NaCl) and when it is in the form of acid (HCl). In the case of stainless steels that can normally be pickled without mechanical pre-treatment (sand-blasting) or chemico-physical pretreatment (treatment in molten salts), the process according to the invention is equally interesting in that it in any case makes possible a considerable increase in the pickling rate given the same conditions, or else makes possible the same rate of reaction even if the temperature and/or concentration of free acids, in particular hydrofluoric acid, present in the bath, are reduced; in this way, a reduction in the consumption involved in the process is achieved, with benefits both in economic and in ecological terms.

The pickling process according to the invention is generally carried out at a temperature of between 20° C. and 70° C., preferably between 40° and 60° C. The temperature depends to a large extent upon the type of steel and the type of plant; in this connection, of fundamental importance is the possibility of using, upstream of the chemical pickling process, mechanical de-scaling treatments. The basic characteristic factors of the process are illustrated in what follows.

It is very important to carry out efficient agitation of the pickling bath so as to ensure continuous renewal of the pickling solution that comes into contact with the metal surface to be treated. The ideal solution is that of spraying, which, however, is not always practicable. In the case of dipping, the injection of air at an adequate rate is the most effective means for guaranteeing evenness of pickling in the most difficult situations (skeins of wire, nests of pipes, heaped items, etc.). In certain cases, it is important to combine recirculation of the pickling solution with the injection of air in order to renew the solution in areas that are difficult to reach with air, such as the upper face of strips which pass horizontally through the pickling bath or the inner surface of pipes.

The air must be appropriately distributed according to the geometry of the bath and of the material undergoing treatment.

The use of air-liquid mixing systems (e.g., ejectors) enables optimization of distribution of the air inside the solution.

Content of Organic Mineral Acids in the Bath

Both the hydrofluoric acid and the sulphuric acid have various functions; among the most important are those of maintaining the pH of the pickling solution at values lower than 2 and of removing the oxides coming from heat treatment and the possible dechromized layer from the metal surface. Hydrofluoric acid, in particular, performs the function of complexing the $Fe^{3+}$ and $Cr^{3+}$ ions in the solution and of depassivating the oxidized material, bringing its electrode potential into the dissolution region.

During the pickling process according to the invention, the concentrations of free hydrofluoric acid and free sulphuric acid are regulated in the following ranges:

$H_2SO_4$ (free)=50 to 200 g/l

HF (free)=0 to 60 g/l

In the latter case, the lower limit has anyway a value such that the total $F^-$ anion present in the solution is at least in a molar ratio of 3:1 with respect to the total $Fe^{3+}$ present.

The total free acidity, which expresses the total content of free acids present in the solution, is between approximately 1 and 7 g. equiv./l.

By "free" acid is herein meant the acid that does not constitute the anion bound in the of salt or complex with the metal cations present in the pickling solution. The total free acidity consisting of the sum of the two free acids ($H_2SO_4$+HF) can be determined simply by acid-base titration of the solution appropriately diluted (preferably at least 1:20) and in the presence of an indicator, such as methyl orange (colour-change pH, 3.1 to 4.4) or bromocresol green (colour-change pH, 3.8 to 5.4). The choice of the colour-change point must be made accurately so as to prevent the formation of hydroxides or basic salts of the metal cations present in the solution (in particular $Fe^{3+}$ and $Cr^{3+}$). It has been found that in practice there is no precipitation of basic salts of $Fe^{3+}$ on account of the presence of $F^-$ anions. Since when the bath is formed, initially the $Fe^{3+}$ ion is generally introduced into the pickling bath in the form of ferric sulphate, it should be borne in mind that in the presence of free HF there will take place complexation of the ferric ion by the fluoride anion, with formation of various fluoroferric complexes, the main one of which has the formula $FeF_3$.

This entails a decrease of free HF in the solution and a simultaneous increase of free sulphuric acid, according to the following reaction scheme:

$$Fe_2(SO_4)_3+6HF \rightarrow 2FeF_3+3\ H_2SO_4$$

A similar complexation with HF takes place for the $Cr^{3+}$ cation present in the pickling solution after a certain period of use.

As regards the "free" sulphuric acid ("free" being understood as defined above), this can be determined on the basis of the electrical conductivity of the pickling solution brought to a pre-established degree of dilution, preferably at least 1:20, and on the basis of an appropriate calibration curve.

The method is based on the fact that the electrical conductivity of the solution containing $H_2SO_4$ and HF in practice represents the total amount of the free sulphuric acid, which, being a strong acid, is completely dissociated into $H^+$ ions, whereas the free hydrofluoric acid is mainly present in the form of undissociated HF acid, and consequently makes a negligible contribution to the electrical conductivity.

The concentration of free HF can be determined by means of a measurement of the electrical conductivity carried out on the sample of solution already examined to determine the free $H_2SO_4$ as described above, after adding to the sample itself a standard volume of concentrated ferric nitrate solution such as to guarantee complexation of the entire HF present, according to the following reaction:

$$Fe(NO_3)_3+nHF \rightarrow Fe\ F_n^{(3-n)+}+nHNO_3$$

from which it is found that for n moles of HF (substantially non-dissociated) there form n moles of $HNO_3$ (strong acid substantially dissociated into $H^+$ and $NO_3^-$), and the resulting increase in electrical conductivity enables the free HF present in the solution to be calculated on the basis of a suitable calibration curve.

The method of electrical conductivity makes it possible to measure, with two determinations, the concentrations of the free $H_2SO_4$ and HF acids present in the solution, with a precision of approximately 5%, which is amply sufficient for the management of an industrial process and which can be easily applied in a plant.

Alternatively, the free hydrofluoric acid can be calculated with good approximation by subtracting, from the total free acidity, the acidity that can be attributed to the free sulphuric acid, measured using the conductometric method described above.

The pickling solution contains quantities of sulphate anion and fluoride anion and of iron cation ($Fe^{3+}$+$Fe^{2+}$) which increase as the use of the pickling solution proceeds. The concentrations of these components broadly range between the following limits:

fluoride anion (total) from 15 to 150 g/l;

sulphate anion (total) from 50 to 350 g/l;

max. total ion ($Fe^{3+}$+$Fe^{2+}$) 120 g/l, preferably not higher than 100 g/l.

Herein by "total fluoride anion" is meant the sum of the fluorinated, anions, such as $F^-$ and $HF_2^-$, both free and complexed.

By "total sulphate anion" is meant the sum of the $SO_4^{2-}$ anions or anions derived from them, such as $HSO_4^-$ bisulphate anions.

Control of Trivalent Iron and of Redox Potential

The redox potential of the pickling system of the present invention is the main function of the $Fe^{3+}/Fe^{2+}$ ratio, but also depends upon the concentration of the hydrofluoric acid (this causes a decrease in the redox potential) and of the sulphuric acid (this causes an increase in the redox potential) present in the solution.

According to the state of the art, the redox potential of the solution is used as the main parameter for the management of ferric/ferrous salt-based solutions.

In actual fact, the value of the potential of the $Fe^{3+}/Fe^{2+}$ pair basically depends upon the ratio between the relative concentrations of the two cations, rather than upon their absolute concentrations.

Since the pickling process is governed by the reaction $$nFe^{3+}+Me^0 \rightarrow Me^{n+}+nFe^{2+}$$

if the concentration of $Fe^{3+}$ is not kept above a critical value (approximately 15 g/l), the pickling reaction is too slow.

Consequently, the following conditions must be met:

$$Fe^{3+} \geqq 15\ g/l$$

$$Fe^{3+}/Fe^{2+} \geqq 0.2$$

$$230\ mV \leqq E_{redox} \leqq 800\ mV$$

The value of the redox potential, measured using an Ag/AgCl reference electrode, during the process is regulated in the range indicated according to the material to be pickled and according to the working cycle adopted.

Regulation of the $Fe^{3+}/Fe^{2+}$ ratio can be achieved in various ways, among which:

addition of stabilized hydrogen peroxide;

addition of oxidants, such as persulphates;

addition of oxidants in the gaseous state, such as air, oxygen-enriched air, and oxygen, possibly in the presence of homogeneous or heterogeneous catalysts, in particular Cu compounds dissolved in the pickling solution;

electrochemical oxidation of the solution in a separate operating phase and recycling of the oxidizing solution in the pickling bath.

Among the chemical oxidants, stabilized hydrogen peroxide is particularly recommended for this use. The stabilizer has the function of decreasing the consumption of hydrogen peroxide by reducing the rate of its decomposition in critical conditions, such as high temperatures, and strong acidity, and high concentration of metallic ions, among which in particular $Fe^{3+}$ and $Cu^{2+}$ in the case of treatment of steels containing copper.

The presence of the stabilizer is particularly important when it is necessary to operate with an excess of hydrogen peroxide in the solution, such as in the cases where the aim is to have a stage of surface finishing separate from the pickling stage proper.

There are numerous known stabilizers that can be used. Among these, particularly indicated are, for instance, phenacetin, compounds of the families of glycol ethers and aliphatic acids, and non-ionic surfactants terminally blocked with an aliphatic or aromatic radical and their mixtures.

Additives

The functionality of the process can be improved by the presence of additives to be added to the pickling solution. In particular, surfactant compounds can be used with the purpose both of increasing the rate of penetration of the solution inside the porous structure of the oxide and of rendering the attack on the dechromized layer homogeneous.

In particular, for reasons of chemical stability of the pickling solutions and for a better control of the frothing properties, particularly suited are non-ionic surfactants and their mixtures of the following families:

alkoxylated alcohols with free terminal hydroxyls alkoxylated alcohols with blocked terminal hydroxyls alkoxylated amines.

According to their concentrations in the solution, these substances are also able to exert a slight inhibitory effect on the base metal, which contributes to improving the surface appearance of the steel.

Work Cycles

The process according to the invention may be carried out both in a single bath and using a number of successive baths.

In the case of the pickling process in a single bath, since the state of passivation of the material must be normally guaranteed at the end of the pickling process and according to the type of the material itself, the redox potential of the solution must be kept above 350 mV, preferably at least 350 mV, and in any case it must fall within the 300–800 mV range.

The $Fe^{3+}/Fe^{2+}$ ratio must be kept >1, and preferably >1.5.

According to the type of material, sometimes it may be necessary to operate with very high $Fe^{3+}/Fe^{2+}$ ratios, and possibly also with excess of hydrogen peroxide. The hydrogen peroxide may be kept constantly in excess in the solution or, where possible, may be fed locally in the end area of the bath (where the material comes out), being added to the pickling solution on a final spray ramp directed onto the surface to be treated.

In the case where the work cycle makes it possible to have at least two successive pickling baths, it is preferable to operate as follows:

Stage 1

Pickling with a solution according to the invention in which the potential of the solution is maintained at values equal to or higher than approximately 230 mV, and the $Fe^{3+}/Fe^{2+}$ ratio is maintained greater than 0.2.

Stage 2

Pickling according to the invention in which the potential of the solution is maintained at values higher than 350 mV, and the $Fe^{3+}/Fe^{2+}$ ratio is maintained greater than 1.5.

Also in this case, if necessary, the hydrogen peroxide can be fed in excess in stage 2, as described previously.

At the end of stage 1, it is preferable to carry out a high-pressure spraying or a mechanical action (brushing) to remove most of the incoherent oxide scale still adhering to the surface. At the end of treatment, the material is in all cases washed with water. Washing must be thorough and preferably carried out by spraying, in that this enables removal even of possible patinas that have formed during pickling or possible residue that has not detached spontaneously from the surface.

In the cases where it is necessary or preferable to have a surface-finishing solution to improve the appearance of the material or to have a separate passivation stage, the following sequence may be adopted:

Stage 1

Pickling according to the invention, in which the potential of the solution is maintained at values higher than 230 mV, and the $Fe^{3+}/Fe^{2+}$ ratio is maintained greater than 0.2.

Stage 2

Finishing and passivation treatment in a solution containing preferably:

sulphuric acid or phosphoric acid at a concentration of 20–50 g/l;

stabilized hydrogen peroxide at a concentration of 2–15 g/l;

free hydrofluoric acid 0–10 g/l.

As an alternative to hydrogen peroxide, other oxidants can be used, such as sodium persulphate.

A final washing with demineralized water is able to prevent any staining or the presence of saline residue on the material.

EXAMPLE 1

A laboratory test was conducted on AISI 304 L (austenitic) stainless-steel wire rod, using the following pickling solutions, the composition of which was determined by the conductometric analyses referred to above as regards the concentration of sulphuric acid and hydrofluoric acid, by iodometric analysis as regards determination of $Fe^{3+}$, and by permangonometric analysis as regards determination of $Fe^{2+}$, as follows:

$H_2SO_4$ (free)=120 g/l HF (free)=25 g/l $Fe^{3+}$=30 g/l $Fe^{2+}$=20 g/l with free acidity of approximately 3.5 g. equiv./l.

b) same as a) +0.6 g/l chloride ions (in the form of NaCl)

c) same as a) +3 g/l chloride ions d) same as a) +6 g/l chloride ions

In all the tests, the pickling temperature was kept at 60±2° C., and air was blown in from underneath at room temperature at a flow rate of approximately 10 Nl/h per liter of solution.

At pre-set intervals, the specimens were taken out of the bath, weighed and visually inspected. For each solution and each material treated, the minimum pickling time, weight loss, and surface appearance of the specimen were determined. The data obtained are given in Table 1.

TABLE 1

| | Weight loss of specimens ($g/m^2$) | | | |
|---|---|---|---|---|
| Immersion time | Solution a) | Solution b) | Solution c) | Solution d) |
| 5 min | 78 | 87 | 94 | 92 |
| 10 min | 101 | 115 | 152 | 190 |
| 20 min | 137 | 170 | 235 | 350 |
| 40 min | 200 | 255 | 400 | 620 |
| (*) Time for complete pickling | 40 min | 20 min | 20 min | 20 min |
| Surface appearance at complete pickling | Excellent | Excellent | Excellent | Good |
| Surface appearance after 40 minutes | Excellent | Excellent | Good | Poor |

(*) visual inspection

The test revealed that for solutions b), c) and d) the pickling time was about half that for solution a). In addition, it may be noted that for solution d), the qualitative result was critical on account of the excessive reaction rate on the base metal, with consequent danger of overpickling.

EXAMPLE 2

Specimens of austenitic stainless-steel wire rod of the type for the production of electrodes in compliance with the DIN 1.4430 Standard, which had a diameter of 5.5 mm and a length of approximately 10 cm and had been hot-rolled, were subjected to pickling treatment in solutions with different chemical compositions in the absence of chloride ions and in the presence of 3.0 g/l of chloride ions introduced as sodium chloride with the purpose of not altering the acidity of the solution. For each test, a quantity of pickling solution of 1000 ml was used.

In ordinary industrial practice, for this material to be chemically pickled within an industrially acceptable time, it is subjected to pre-treatment in an oxidizing or reducing fused-salt bath.

The specimens of material in the test in question were not subjected to any pre-treatment stage in order to compare them to specimens of the same material previously treated in oxidizing fused salts and pickled in a solution of the same composition not containing chloride ions.

During the test the following were measured on the non-pretreated specimens: loss in weight of the test specimen after 30 minutes of treatment, minimum pickling time, total weight loss at end of pickling, and pickling rate. On the pre-treated specimens, on account of the different thickness of the oxide layer as compared to the non-pretreated specimens, only the minimum pickling time was determined.

The results are given in Table 2, each result representing the mean of two separate determinations made in the same solution.

TABLE 2

| | Specimen | | | | | | | | |
|---|---|---|---|---|---|---|---|---|---|
| Parameter | A | B | C | D | E | F | G | H | I |
| Molten salts (30 min at 490° C.) | YES | NO | NO | YES | NO | NO | YES | NO | NO |
| $Fe^{3+}$, g/l | 30 | 30 | 30 | 30 | 30 | 30 | 30 | 30 | 30 |
| $Fe^{2+}$, g/l | 0 | 0 | 0 | 30 | 30 | 30 | 30 | 30 | 30 |
| $H_2SO_4$ (free), g/l | 120 | 120 | 120 | 120 | 120 | 120 | 120 | 120 | 120 |
| HF (free), g/l | 35 | 35 | 35 | 35 | 35 | 35 | 35 | 35 | 35 |
| $Cl^-$, g/l | 0 | 0 | 3.0 | 0 | 0 | 3.0 | 0 | 0 | 3.0 |
| Temp., ° C. | 50 | 50 | 50 | 50 | 50 | 50 | 60 | 60 | 60 |
| ΔP (t = 30 min) $g/m^2$ | n.d. | 76 | 129 | n.d. | 84 | 131 | n.d. | 112 | 159 |
| Time for complete pickling, min | 45 | 85 | 50 | 50 | 90 | 50 | 30 | 55 | 30 |
| Final ΔAP, $g/m^2$ | n.d. | 127 | 152 | n.d. | 130 | 151 | n.d. | 136 | 160 |
| Pickling rate, $g/m^{2*}$ min | n.d. | 1.49 | 3.04 | n.d. | 1.44 | 3.02 | n.d. | 2.47 | 5.3 |

The results highlight three important aspects:

The pickling time for the specimens that did not undergo pre-treatment in the solutions containing chloride ions (C, F, I) was almost half the time necessary for the solution not containing chloride ions (B, E, H).

The pickling time in the solutions containing chloride ions (C,F,I) was roughly the same as for the specimens pre-treated in molten salts and pickled in solutions not containing chloride ions (A, D, G).

The effect of chloride ions on the rate of pickling (F) is more important than the effect of the increase in temperature from 50° C. to 60° C. (E, H) in solutions not containing chloride ions.

EXAMPLE 3

Pipes made of austenitic steel of the NiCr23Fe series (60% Ni, 23% Cr—specimen ❶) and of the super austenitic-duplex series, such as (22% Cr, 5% Ni, 3% Mo—specimen ❷) or else (25% Cr, 7,5% Ni, 4% Mo—specimen ❸) can be chemically pickled only with very long treatment times and with very high acid concentrations.

In the case of the NiCr23Fe series, pickling is moreover possible only after pre-treatment in an oxidizing solution, such as a molten-salt solution or alkaline-permanganate solution.

The treatment of these steels in solutions containing chloride ions in the range of the present invention enabled pickling to be carried out in much shorter times than using processes without chloride in the three cases considered.

TABLE 3

| | Specimen | | | | | |
|---|---|---|---|---|---|---|
| Parameter | ❶ | ❶ | ❷ | ❷ | ❸ | ❸ |
| KMnO4 + NaOH (40 min at 90° C.)(*) | YES | YES | NO | NO | NO | NO |
| $Fe^{3+}$, g/l | 30 | 30 | 30 | 30 | 30 | 30 |
| $Fe^{2+}$, g/l | 30 | 30 | 30 | 30 | 30 | 30 |
| $H_2SO_4$ (free), g/l | 130 | 130 | 130 | 130 | 130 | 130 |
| HF (free), g/l | 30 | 30 | 30 | 30 | 60 | 60 |
| $Cl^-$, g/l | 0 | 3.0 | 0 | 3.0 | 0 | 5.0 |
| Temp., ° C. | 60 | 60 | 60 | 60 | 60 | 60 |
| Time for complete pickling, min | 240 | 30 | 330 | 150 | 240 | 120 |
| Final ΔP, g/m$^2$ | 60** | 140 | 16.1 | 14.5 | 18.0 | 16.0 |

**Pickling of inner surface not complete
(*)4% KMnO4 + 10 to 12% NaOH

EXAMPLE 4

Specimens of hot-rolled and sand-blasted strip made of stainless steel of the AISI 304 series and having a thickness of 4.8 mm underwent pickling in solutions containing HF, $H_2SO_4$, $Fe^{3+}$, and $Fe^{2+}$, both in the absence and in the presence of chloride ions.

The total stay time of this material on the production line was approximately 3 minutes, during which the material passed through two pickling tanks and underwent, both after the first tank and at end of cycle, an operation of washing+mechanical brushing.

At the end of the process, the mean weight loss for this material was in the 13–18 g/m$^2$ range.

The laboratory tests were conducted on a liter of solution in the presence of agitation by blowing in air, but in the absence of any mechanical action. The result must therefore be interpreted for comparison with the original solution.

The result was assessed by measuring weight loss and surface appearance of the test specimen every 60 seconds of pickling and at the end of the 3 minutes of treatment.

For the test, the following solutions of composition measured according to the analytical procedures already described were used:

Reference Solution $[H_2SO_4]_{free}$=130 g/l $[HF]_{free}$=30 g/l $[Fe^{3+}]$=30 g/l $[Fe^{2+}]$=15 g/l T=60±2° C.

Solution A 2.0 g/l of chloride ions in the form of HCl were added to the reference solution.

Solution B 5.0 g/l of chloride ions in the form of HCl were added to the reference solution. Table 4 gives the partial variation in weight loss after every 60 seconds, the total weight loss at end of cycle, and the surface appearance of the test specimen.

TABLE 4

| | | Weight loss of specimens g/m$^2$ | |
|---|---|---|---|
| | Reference solution [Cl] = 0 | Solution A [Cl] = 2 g/l | Solution B [Cl] = 2 g/l |
| Δ $P_1$, g/m$^2$ for t = 60 sec | 4.8 | 4.8 | 16.6 |
| Δ $P_2$, g/m$^2$ for t = 120 sec | 1.7 | 4.5 | 0.6 |
| Δ $P_3$, g/m$^2$ for t = 180 sec | 1.5 | 4.5 | 0.16 |
| Δ $P_{total}$, g/m$^2$ | 8.0 | 13.8 | 17.3 |
| Surface appearance after 3 minutes (visual inspection) | Test specimen coated with thin but even film of oxide | Some areas with thin film of oxide | Complete pickling |

Also in this case, even though the treatment time was very short as compared to the tests previously examined, it was reconfirmed that the pickling rate, as a result of the addition of chloride ions, was twice that of the same solution not containing chloride ions.

What is claimed is:

1. Process for pickling stainless steels selected from the group consisting of the austenitic, ferritic and martensitic series, duplex steels, superaustenitic and superferritic steels, and Ni or Ni/Cr based superalloys, carried out at a temperature of between 20° and 70° C., with the use of a pickling solution containing the following basic ingredients:

$H_2SO_4$ (free acid): 50 to 200 g/l

HF (free acid): 0 to 60 g/l $F^-$ anion (total): 5 to 150 g/l $SO_4^{2-}$ anion (total): 50 to 350 g/l $Fe^{3+}$ in a quantity of at least 15 g/l, Cl-anion in a quantity of between 0.1 and 10 g/l in said solution the total free acid ($H_2SO_4$+HF) is between 1 and 7 g equivalent/l where by "free acid" is meant the acid that does not constitute the anion bound in the form of salts or complexes with the metal cations present in the solution: and feeding a sufficient amount of oxidant into said pickling solution during the pickling process in order to oxidize at least part of the $Fe^{2+}$ ions, formed in the pickling process, to $Fe^{3+}$ ions in order to maintain the $Fe^{3+}/Fe^{2+}$ ratio at a value of at least 0.2 and the redox potential of the solution at a value of between +230 and +800 mV.

2. Process according to claim 1 in which the pickling solution is kept under agitation by means of forced circulation, by sending it in the form of spray onto the surface to be treated or by injection of air.

3. Process according to claim 1 in which the chloride anion is introduced into the pickling solution in the form of HCl or soluble chloride.

4. Process according to claim 1 in which the chloride anion in the pickling solution is in a quantity of between 1 and 5 g/l.

5. Process according to claim 1 in which the oxidizing agent used is $H_2O_2$.

6. Process according to claim 5 in which to the pickling solution is added a stabilizer for hydrogen peroxide.

7. Process according to claim 1 in which the oxidation of $Fe^{2+}$ to $Fe^{3+}$ is carried out by blowing air into the solution, in which a copper compound is dissolved as an oxidation catalyst.

8. Process according to claim 1 in which the material to be pickled has undergone a stage of mechanical or chemico-physical pretreatment by means of molten salts.

9. Process according to claim 1 in which the material to be pickled has undergone a preliminary chemical treatment with an aqueous solution containing $H_2SO_4$, HCl, HF and their mixtures.

10. Process according to claim 1 in which the pickled material subsequently undergoes passivation treatment in a bath containing:

sulphuric acid or phosphoric acid at concentrations of between 20 and 50 g/l;

free hydrofluoric acid at a concentration of from 0 to 10 g/l;

stabilized hydrogen peroxide at a concentration of from 2 to 15 g/l or another equivalent oxidant (alkaline persulphate).

11. Process according to claim 1 carried out in a single-bath plant operating at a redox potential greater than 300 mV with an $Fe^{3+}/Fe^{2+}$ ratio higher than 1.

* * * * *